US010660178B2

(12) United States Patent
Chen et al.

(10) Patent No.: US 10,660,178 B2
(45) Date of Patent: May 19, 2020

(54) DYNAMIC LIGHTING METHOD AND DEVICE

(71) Applicant: GUANGDONG WLIGHT VISUAL HEALTH RESEARCH INSTITUTE, Guangzhou (CN)

(72) Inventors: Ziping Chen, Guangzhou (CN); Mengzhen Chen, Guangzhou (CN); Lei Huang, Guangzhou (CN)

(73) Assignee: GUANGZHOU WLIGHT EYE-TECH CO., LTD, Guangzhou, Guangdong Prov. (CN)

( * ) Notice: Subject to any disclaimer, the term of this patent is extended or adjusted under 35 U.S.C. 154(b) by 0 days.

(21) Appl. No.: 16/257,198

(22) Filed: Jan. 25, 2019

(65) Prior Publication Data

US 2019/0166664 A1 May 30, 2019

Related U.S. Application Data

(63) Continuation of application No. PCT/CN2017/094112, filed on Jul. 24, 2017.

(51) Int. Cl.

| | |
|---|---|
| ***H05B 45/10*** | (2020.01) |
| ***H05B 45/37*** | (2020.01) |
| ***H05B 45/20*** | (2020.01) |
| ***H05B 47/10*** | (2020.01) |
| *F21Y 113/13* | (2016.01) |

(Continued)

(52) U.S. Cl.

CPC ..... *H05B 45/37* (2020.01); *H05B 45/10* (2020.01); *H05B 45/20* (2020.01); *H05B 47/10* (2020.01); *F21Y 2105/12* (2016.08); *F21Y 2113/13* (2016.08); *F21Y 2115/10* (2016.08); *H05B 47/19* (2020.01)

(58) Field of Classification Search

None

See application file for complete search history.

(56) References Cited

U.S. PATENT DOCUMENTS

2011/0234612 A1* 9/2011 Wei ..... G09G 3/3426 345/589

FOREIGN PATENT DOCUMENTS

CN 101363580 A * 2/2009
CN 101363580 A 2/2009

(Continued)

*Primary Examiner* — Dedei K Hammond

(74) *Attorney, Agent, or Firm* — Welsh Flaxman & Gitler LLC

(57) ABSTRACT

Disclosed is a dynamic lighting method, which includes a power supply output module of a dynamic lighting device outputs a first power supply signal according to a lighting control signal, electric parameters of the first power supply signal include one or more groups of dynamically changed electrical parameters, one or multiple lighting parts of the dynamic lighting device generate a dynamically changed light signal under driving of the first power supply signal, so that the dynamic lighting device outputs a light of dynamic illumination, a change rate of illumination of the light is not more than 0.02 during any time period of 0.1 second, and a ratio of the minimum and maximum values of the illumination of the light outputted by the dynamic lighting device is not more than 50%. The lighting method will result that the physiological structures of the eyes change with change of the light accordingly to overcome the defect that the user easily feels visual fatigue.

20 Claims, 4 Drawing Sheets

(51) Int. Cl.

| | |
|---|---|
| *F21Y 115/10* | (2016.01) |
| *F21Y 105/12* | (2016.01) |
| *H05B 47/19* | (2020.01) |

(56) References Cited

FOREIGN PATENT DOCUMENTS

| | | | | |
|---|---|---|---|---|
| CN | 102182985 | A | | 9/2011 |
| CN | 202488851 | U | * | 10/2012 |
| CN | 103167697 | A | | 6/2013 |
| CN | 104806915 | A | | 7/2015 |
| JP | 2010009848 | A | | 1/2010 |
| JP | 2010182660 | A | | 8/2010 |

* cited by examiner

DYNAMIC LIGHTING METHOD AND DEVICE

This application claims priorities from Chinese patent application of No. 201610615641.7, entitled a dynamic lighting method, No. 201610617037.8, entitled a dynamically changing Lighting Method, No. 201610615656.3, entitled a dynamic lighting method with dynamic change of color temperature, No. 201610609592.6, entitled a dynamic lighting device, filed on Jul. 28, 2016, in National Intellectual Property Administration, PRC.

TECHNICAL FIELD

The present invention relates to the technical field of lighting, in particular to a dynamic lighting method and device.

RELATED ART

Vision health has been a common concerned important problem to all people. According to the study of The Report of Vision Health of Chinese reported by the Center of Health Development Research in China, of Peking university, reported on June, 2015, the people over 5 years old who are of myopia and hyperopia are mostly students and office workers in China, in 2012. The number of people of myopia or hyperopia is about 500 million, and the number of people of myopia is about 450 million.

Currently, common lighting equipment may only provide one or a limited number of optional lighting parameters usually, such as one level or several fixed level of illumination, luminous intensity, color temperature, etc., there are also available equipment which are capable of linearly adjusting lighting parameters by hand. Although the lighting equipment is adjustable, it is only allowable to make dimming control under a human operation to change luminous intensity, color temperature, etc. However, users usually would not make frequent dimming operation actively to the lighting equipment when using it. Therefore, whether the existing lighting equipment that is dimmable or is not dimmable can provide light for users with a single lighting parameter during its actual use.

However, when the lighting parameter is single, eye structure of human eye, which includes pupil, ciliary muscle and lens, is stayed in one state for a long time, and that causes visual fatigue of human eye thereby it affects visual health.

SUMMARY OF THE INVENTION

The object of the present invention is to provide a method of dynamic lighting and its device, which may automatically and dynamically change and control the electrical parameters for lighting of lighting parts, in order that the dynamic lighting device output light of dynamic illumination, and the light is incident into the eyes of the user, and then the physiological structures of the eyes is changed with change of the light accordingly, thus it may overcome the defect that the user easily feels visual fatigue because of the long-term use of the eyes. By appropriately controlling a dynamic change rate of the light, the user himself will not perceive the change in the light subjectively, and it is guaranteed that the users have good vision health without interfering the user using the dynamic lighting device.

In order to achieve the object, on one aspect, the present invention provides a method of dynamic lighting, which comprises:

a power supply output module of a dynamic lighting device outputs a first power supply signal according to a lighting control signal, wherein electric parameters of the first power supply signal include one or more groups of dynamically changed electrical parameters, one or multiple lighting parts of the dynamic lighting device generate a dynamically changed light signal under driving of the first power supply signal, so that the dynamic lighting device outputs a light of dynamic illumination, a change rate of illumination of the light is not more than 0.02 during any time period of 0.1 second, and a ratio of the minimum and maximum values of the illumination of the light outputted by the dynamic lighting device is not more than 50%.

Further the dynamic lighting device outputs the light of dynamic illumination and is incident into eyes of a user, so that eye structure of the user is changed dynamically with dynamic change of the light of dynamic illumination.

Further, the illumination of the light of dynamic illumination ranges from 50 lux to 10000 lux.

Further the multiple lighting parts generate the dynamically changed light signal under driving of the first power supply signal at the same time, or the multiple lighting parts generate the dynamically changed light signal under driving of the first power supply signal at different times.

Further the lighting parts include multiple light emitters, and the electrical parameters include a current and/or a voltage, that one or multiple lighting parts generate the dynamically changed light signal under driving of the first power supply signal includes all or some light emitters of one or multiple lighting parts, is driven by the first power supply signal, and change the illumination of the light emitters.

Further, the lighting parts include multiple light emitters, and the electrical parameters include an on-off state of the power supply, that one or multiple lighting parts generate the changed dynamically light signal under driving of the first power supply signal includes some light emitters of one or multiple lighting parts are driven by the first power supply signal to be turned on or off.

Further, the lighting parts include one or more types of light emitters.

Further that the power supply output module of the dynamic lighting device outputs the first power supply signal according to the lighting control signal includes:

the power supply output module of the dynamic lighting device receives a lighting control command inputted by the user, generates the lighting control signal, and outputs the first power supply signal according to the lighting control signal, or the power supply output module of the dynamic lighting device outputs the first power supply signal according to the lighting control signal which is predetermined.

On second aspect, the embodiment of the present invention provides a dynamic lighting method. The method comprises:

a power supply output module of a dynamic lighting device alternately outputs a first power supply signal and a second power supply signal according to a lighting control signal, wherein electric parameters of the first power supply signal include one or more groups of first electrical parameters which are changed dynamically, and electric parameters of the second power supply signal include one or more groups of second electrical parameters which are predetermined and fixed or dynamically changed, one or multiple lighting parts of the dynamic lighting device generate a first light signal which is changed dynamically under driving of the first power supply signal, so that the dynamic lighting device discontinuously outputs a first light of dynamic illumination, a change rate of illumination of the first light of dynamic illumination are not more than 0.02 and smaller than 0.2 during any time period of 0.1 second, and a ratio of the minimum and maximum values of the illumination is not more than 50% during a single output time duration of the first light of dynamic illumination outputted by the dynamic lighting device.

Further, the first light of dynamic illumination outputted by the dynamic lighting device is incident into eyes of a user, so that the user perceives dynamic change of the light and eye structure of the user is changed dynamically with first dynamic change of the first light of dynamic illumination.

The method further comprises:

one or multiple lighting parts of the dynamic lighting device driven by the second power supply signal, generate a second light signal which is constant or dynamically changed, so that the dynamic lighting device outputs a constant light or a second light of dynamic illumination, during an off-time for discontinuously outputting the first light of dynamic illumination, wherein second dynamic change is that a change rate of the illumination of the second light of dynamic illumination is not more than 0.02 during any time period of 0.1 second.

Further, any output time duration of the first light of dynamic illumination is no longer than 10% of the off-time that is an interval between this and next output time duration of the first light of dynamic illumination, and no longer than 10% of the off-time that is an interval between the previous and this output time duration of the first light of dynamic illumination.

Further, the output time duration of the first light of dynamic illumination is no more than 10 seconds every single time.

Further, the illumination of the light of dynamic illumination ranges from 5 lux to 10000 lux.

Further, the multiple lighting parts generate the first light signal which is changed dynamically under driving of the first power supply signal at the same time, or the multiple lighting parts generate the first light signal which is changed dynamically under driving of the first power supply signal at different time.

Further, the lighting parts include multiple light emitters, the electrical parameters include a current and/or a voltage, that one or multiple lighting parts generate the light signal which is changed dynamically under driving of the first power supply signal includes all or some light emitters of one or multiple lighting parts is driven by the first power supply signal and change their illumination for lighting of the light emitters, or the electrical parameters include an on-off state of a power supply, that one or multiple lighting parts generate the light signal which is changed dynamically under driving of the first power supply signal includes some light emitters of one or multiple lighting parts are driven by the first power supply signal and turned on or off.

Further, the lighting parts include one or more types of light emitters.

Further, the power supply output module of the dynamic lighting device alternately outputs the first power supply signal and the second power supply signal according to the lighting control signal includes:

the power supply output module of the dynamic lighting device receives a lighting control command inputted by a user, generate the lighting control signal, and alternately outputs the first power supply signal and the second power supply signal according to the lighting control signal, or the power supply output module of the dynamic lighting device alternately outputs the first power supply signal and the second power supply signal according to the lighting control signal which is predetermined.

On third aspect, the embodiment of the present invention provides a dynamic lighting method with dynamic change of a color temperature, the method comprises:

a power supply output module of a dynamic lighting device outputs a first power supply signal according to a lighting control signal, wherein electric parameters of the first power supply signal include one or more groups of electrical parameters which are changed dynamically, one or multiple lighting parts of the dynamic lighting device generate a light signal with dynamic change of color temperature under driving of the first power supply signal, so that the dynamic lighting device outputs a light with dynamic change of the color temperature.

a change rate of illumination of the first light of dynamic illumination are not more than 0.02 and smaller than 0.2 during any time period of 0.1 second, and a ratio of the minimum and maximum values of the illumination is not more than 50% during a single output time duration of the first light of dynamic illumination outputted by the dynamic lighting device.

Further, the first light of dynamic illumination outputted by the dynamic lighting device is incident into eyes of a user, so that the user perceives dynamic change of the light and eye structure of the user is changed dynamically with first dynamic change of the light.

The method further comprises:

one or multiple lighting parts of the dynamic lighting device driven by the second power supply signal, generate second light signal which is constant or dynamically changed, so that the dynamic lighting device outputs a constant light or a second light of dynamic illumination, during an off-time for discontinuously outputting the first light of dynamic illumination, wherein second dynamic change is a change rate of the illumination of the second light of dynamic illumination is not more than 0.02 during any time period of 0.1 second.

any output time duration of the first light of dynamic illumination is no longer than 10% of the off-time that is an interval between this and next output time duration of the first light of dynamic illumination, and no longer than 10% of the off-time that is an interval between the previous and this output time duration of the first light of dynamic illumination.

The output time duration of the first light of dynamic illumination is no more than 10 seconds every single time.

The illumination of the light of dynamic illumination ranges from 5 lux to 10000 lux.

The multiple lighting parts generate the first light signal which is changed dynamically under driving of the first power supply signal at the same time, or the multiple lighting parts generate the first light signal which is changed dynamically under driving of the first power supply signal at different time.

The lighting parts include multiple light emitters, the electrical parameters include a current and/or a voltage, that one or multiple lighting parts generate the light signal which is changed dynamically under driving of the first power supply signal includes all or some light emitters of one or multiple lighting parts is driven by the first power supply signal and change their illumination of the light emitters, or the electrical parameters include an on-off state of a power supply, that one or multiple lighting parts generate the light signal which is changed dynamically under driving of the first power supply signal includes some light emitters of one or multiple lighting parts are driven by the first power supply signal and turned on or off.

The lighting parts include one or more types of light emitters.

The power supply output module of the dynamic lighting device alternately outputs the first power supply signal and the second power supply signal according to the lighting control signal includes:

the power supply output module of the dynamic lighting device receives a lighting control command inputted by a user, generate the lighting control signal, and alternately outputs the first power supply signal and the second power supply signal according to the lighting control signal, or the power supply output module of the dynamic lighting device alternately outputs the first power supply signal and the second power supply signal according to the lighting control signal which is predetermined.

On four aspect, the embodiment of the present invention provides a dynamic lighting device:

a power supply output module, for outputting a first power supply signal according to a lighting control signal, wherein electric parameters of the first power supply signal include one or multiple groups of electrical parameters which are changed dynamically.

one or multiple lighting parts, for generating a light signal which is changed dynamically under driving of the first power supply signal so that the dynamic lighting device outputs a light of dynamic illumination, and the light of dynamic illumination is incident into eyes of a user, resulting that eye structure of the user is changed dynamically with the dynamic change of the light.

Preferably, the lighting parts are used for generating a light of which change rate of the illumination is not more than 0.02 during any time period of 0.1 second, driven by the first power supply signal.

Preferably, the lighting parts are for generating a light of which dynamic change of color temperature is not larger than 10K during any time period of 0.1 second, driven by the first power supply signal.

Preferably, the lighting parts are for generating a light of which change rate of illumination is larger than 0.02 and smaller than 0.2 during any time period of 0.1 second, driven by the first power supply signal.

The power supply output module is further for outputting a second power supply signal which and the first power supply signal are alternately outputted according to the lighting control signal, the one or multiple lighting parts are further for generating a second light signal which is constant or dynamically changed, so that the dynamic lighting device outputs a constant light or a second light of dynamic illumination, during an off-time for discontinuously outputting the first light of dynamic illumination, wherein second dynamic change is that a change rate of the illumination of the second light of dynamic illumination is not larger than 0.02 during any time period of 0.1 second.

Preferably, The multiple lighting parts are used for generating the light signal which is changed dynamically under driving of the first power supply signal at the same time, or generating the light signal which is changed dynamically under driving of the first power supply signal at different times.

Preferably, the lighting parts include multiple light emitters, the light emitters are one or more types of light emitters, the electrical parameters include a current and/or a voltage, all or some light emitters under driving of the first power supply signal change their illumination or color temperature of the light emitters.

Preferably, the lighting parts include multiple light emitters, the light emitters include one or more types of light emitters, the electrical parameters include an on-off state of the power supply.

some light emitters under driving of the first power supply signal, are turned on or off.

The dynamic lighting device further includes a power supply input interface.

an output of the power supply input interface is connected with an input of the power supply output module, for connecting external power supply to the dynamic lighting device.

The dynamic lighting device further includes a memory storage, connected with the power supply output module, the memory storage is for storing the lighting control signal.

the power supply output module is for obtaining the lighting control signal stored in the memory storage.

The dynamic lighting device further includes an input device, connected with the power supply output module, the input device is for receiving the lighting control command which are inputted by a user, generating the lighting control signal according to the lighting control command, and sending the lighting control signal to the power supply output module.

The embodiments of the present invention provide the method of dynamic lighting, which may automatically and dynamically change and control the electrical parameters for lighting of lighting parts, in order that the dynamic lighting device output dynamic variable light, and the light is incident into the eyes of the user, and then the physiological structures of the eyes change with change of the light accordingly, thus it may overcome the defect that the user easily feels visual fatigue because of the long-term use of the eyes and it is guaranteed that the user have good vision health.

DETAILED DESCRIPTION OF THE INVENTION

The technical solutions of this invention will be described further in detail through the attached drawings and embodiments.

In order to better understand the dynamic lighting methods proposed in the embodiments of this invention, the principle of human eye structures changing with light is explained below firstly.

When the parameters of the light incident into human eyes such as illumination, color temperature, luminous intensity, luminous flux, and angle change, the iris of human eye will adjust the pupil size automatically with the light change in order to control luminous flux. The movement of the iris will lead to that of the ciliary muscle, while the movement of the ciliary muscle will lead to that of the lens, and thus will result in the so-called 'three linkage of eye optometry system' in the visual field. The linkage movement of the iris, the ciliary muscle and the lens cause the physiological structure of the eyes to be changed, that is, the shapes and/or sizes of the iris, ciliary muscle and lens is changed.

The dynamic lighting methods of the embodiments of the present invention are provided based on that principle.

Figure 1:
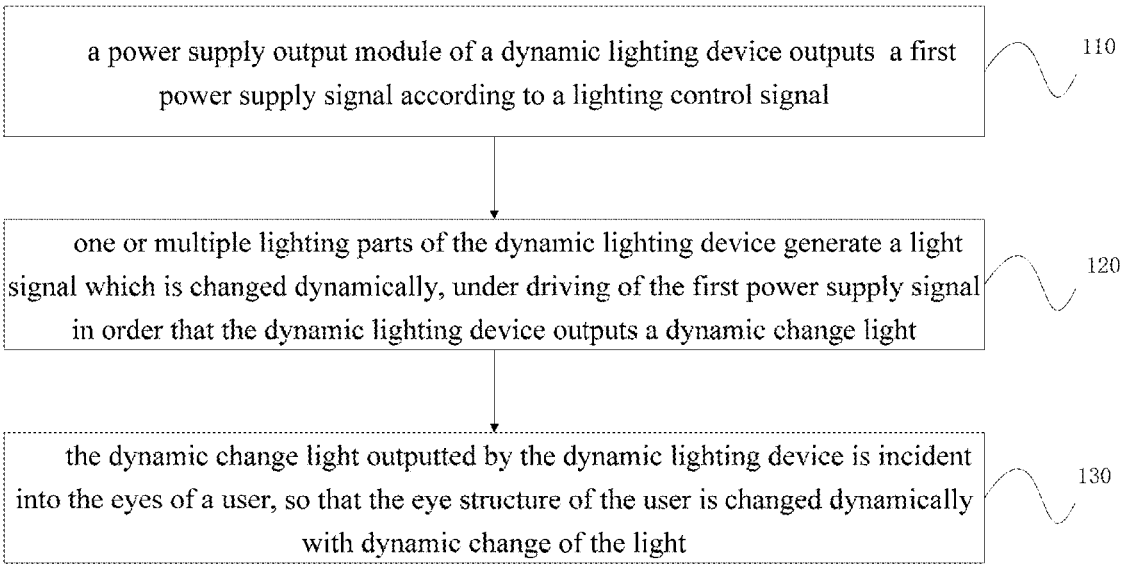
FIG. 1 is a flow chart of a dynamic lighting method provided by Embodiment 1 of the invention.

FIG. 1 is a flow chart of a dynamic lighting method provided by Embodiment 1. As shown in FIG. 1, the dynamic lighting method includes the following steps.

Step 110, a power supply output module of a dynamic lighting device outputs a first power supply signal according to a lighting control signal.

The power supply output module of the dynamic lighting device is a module used to provide power a supply driving signal for a lighting part. The power supply driving signal is determined as the first power supply signal, and the electric parameter of the first power supply signal include one or multiple groups of electrical parameters which are changed dynamically. In the case of multiple groups of electrical parameters, the multiple groups of electrical parameters are outputted in multi-channels.

The electrical parameters may be current and voltage specifically, which include the voltage value and change rate of the voltage, the current magnitude and change rate of the current, and so on. The electrical parameters may be either voltage or current, or may be the on-off state of the output of the power supply output module.

The power supply output module may output the first power supply signal according to an input command of a user or a predetermined configuration.

In the first solution, the power supply output module may receive a lighting control command inputted by a user, and generate a lighting control signal, and outputs first power supply signal according to the lighting control signal.

The manner for receiving the lighting control command inputted by a user may be implemented by a wired or wireless way.

For example, the manner includes by sensing the lighting mode selection keys which set on a dynamic lighting device being touched by the user, or receiving the lighting control command which are remotely inputted by the users operating remote control devices through wirelessly transmitting.

In the second solution, the power supply output module of the dynamic lighting device outputs first power supply signal according to the lighting control signal which are predetermined.

The predetermined lighting control signal may be stored in a memory storage of the dynamic lighting device, and the power supply output module may read the memory storage to obtain signal. The memory storage may be read-only memory (ROM) chip or any other types of solid non-volatile semiconductor memories. The manner for writing the predetermined lighting control signal to the memory storage may be implemented in a wired input manner, alternatively this may be realized via an interface connected to the memory storage, such as an infrared interface, a bluetooth interface, a USB interface, etc.

Step 120, one or multiple lighting parts of the dynamic lighting device generate a light signal which is changed dynamically, under driving of the first power supply signal in order that the dynamic lighting device outputs a light of dynamic illumination.

Concretely, there is available one or multiple lighting parts connected to the power supply output module in the dynamic lighting device. In case where there are multiple lighting parts, these lighting parts may be controlled and driven by the same group of electrical parameters, or by multiple groups of electrical parameters which are multiple outputted. Thus, these multiple lighting parts are driven by the first power supply signal and generate a light signal which is change dynamically at the same time or different times.

Further, each lighting part includes one or more light emitters, which is driven by the first power supply signal to be turned on or off or to be changed the illumination, therefore, it overall affects the light signal outputted by each lighting part to be changed.

The power supply signal output to each lighting part of the multiple lighting parts may be the same group of electrical parameters output to all of the light emitters, or one group of electrical parameters output to some light emitters and the other group of electrical parameters output to other light emitters. That is, the lighting parts and light emitters can be controlled independently in the method provided by this embodiment.

In an example, the current and the voltage or any one of the current and the voltage output to some or all light emitters is dynamically changed, to change the illumination of these light emitters, such that the light signal outputted by the lighting parts is changed dynamically.

In a preferred embodiment, the dynamically changed current may be provided to all the light emitters of the lighting parts, such as 200 LEDs to realize outputting the dynamically changed light signal. For example, firstly, an initial current is inputted to drive the lighting parts, so that all 200 LEDs of the dynamic lighting device start to light. Subsequently, during the process of dynamically lighting, the current inputted into each light emitter increases by 1% of the initial current every 0.1 second, in order to drive these light emitters to output dynamically changed light signal. The time duration of current increasing continuously is configured for 10 seconds, therefore the light signal outputted by the lighting part increase dynamically during this time duration. Assume that the change in illumination is proportional to the change in the current, such that the illumination of the outputted light signal is increased by 100% in 10 seconds dynamically. After that, the current inputted into each light emitter decreases by 1% of the initial current every 0.1 second, in order to drive these light emitters to output dynamically changed light signal. The time duration of current decreasing continuously is configured for 10 seconds, therefore the light signal outputted by the lighting part decrease dynamically during this time duration. Assume that the change in the illumination is proportional to that in the current, such that the illumination of the light signal outputted is decreased by 50% in 10 seconds dynamically.

In another specific example, the means for change the illumination of these light emitters, such that the light signal outputted by the lighting parts is changed dynamically can be implemented by dynamically turning on or off the output of the power from the supply output module to some light emitters of the lighting parts.

In a preferred embodiment, the lighting part has 200 individual light emitters, the power supply input of each light emitter may be controlled to be turned on or off independently. Firstly, 100 light emitters of those are controlled to be on by the power supply signal, and the dynamic lighting device starts to light. Then, it begins the process of dynamically lighting with turning on one light emitter every 0.1 second, until all the light emitters are turned on. After that, 3 light emitters are controlled to be turned off every 0.1 second, and that lasts 1 second. Then, two light emitters are controlled to turn off every 0.1 second, and that lasts 2 seconds. And, one light emitter is controlled to turn off every 0.1 second, until 100 light emitters are left. The above mentioned dynamic lighting procedure is repeated to realize dynamic change in the light signal outputted by the lighting parts.

The exemplary change mentioned above may be implemented by the manners that the output quantity of the light signal of light emitters is increased or decreased at a fixed proportion, or, by the manner that the output quantity of the light signal of light emitters is changed dynamically at an unfixed proportion.

In order not to affect the users' utilization of lighting devices, the lighting parts driven by the first power supply signal generate a dynamically changed light signal with the result that the change rate of the illumination of the light outputted by the dynamic lighting device are not larger than 0.02 during any time period of 0.1 second, in case that whether the lighting parts are controlled independently or integrally, or the light emitters are controlled independently or integrally.

The principle for the above process is the visual retention of eyes that vision will maintain the feeling of a light imagine for a limited time once the light imagine is formed on retina, and this physiological phenomenon is called as persistence of vision. For different brightness in different environments, the duration of the persistence of vision is different, and the higher the brightness, the shorter the duration of the persistence of vision. Regarding the environment using the lighting device, the duration of the persistence of vision is about from 0.1 to 0.4 second in case of the environment with medium brightness. Therefore, the change rate of the illumination is set to be not larger than 0.02 in 0.1 second, to make sure that the change in light in each duration of the persistence of vision are tiny, so that the change in the light are imperceptible to the users of the lighting device and will not interfere with the use of the lighting device.

The change of the illumination needs to be limited in a certain range to meet the requirement for lighting. The illumination in this embodiment is set to range from 50 lux to 10000 lux.

Further, in order to achieve the purpose that physiological structures of the eyes of the users can be changed because of the light, the variable quantity of the illumination of the light need to at a certain proportion, and further the ratio of the minimum and maximum values of the illumination of the outputted light needs to be not larger than 50%.

In an embodiment, the change of the illumination is dynamic. During different dynamic variation periods, the illumination may continuously increase or decrease, or it may increase with fluctuations or decrease with fluctuations.

In other words, during a dynamic variation period when the illumination of the outputted light increases (including increases continuously or increases with fluctuations), the change rate for increasing the illumination is not smaller than 100%. And during a dynamic variation period when the illumination of the outputted light decreases (including decreases continuously or decreases with fluctuations), the change rate for decreasing the illumination is not smaller than 50%.

The dynamic change of the illumination of the outputted light is directly related to the change in the first power supply signal, therefore it can be configured by controlling the signal. In a preferred embodiment, the dynamic change can be set to regularly change.

Further, the types of the light emitters included in a lighting part may be the same or different. For example, yellow LEDs and white LEDs can be set in a lighting part at the same time.

Step 130, the light of dynamic illumination outputted by the dynamic lighting device is incident into the eyes of a user, so that the eye structure of the user is changed dynamically with dynamic change of the light.

The light of dynamic illumination generated by step 110 and step 120 mentioned above is incident into the eyes of the user of the dynamic lighting device, so that the eye structures including one or more of the iris, ciliary muscle and lens, of the user is changed dynamically with the dynamic change in the light. With the reasonable setting of the change rate of the illumination during the duration of the persistence of vision, the user will not perceive the dynamic change in the light subjectively, thus it will not interfere the user using the dynamic lighting device normally.

The present invention provides a method of dynamic lighting, which may automatically and dynamically change and control the electrical parameters for lighting of lighting parts, so that the dynamic lighting device output dynamic variable light, and the light is incident into the eyes of the user, and then the physiological structures of the eyes change with change of the light accordingly, thus it may overcome the defect that the user easily feels visual fatigue because of the long-term use of the eyes. By reasonably controlling dynamic change rate of the light, the user himself will not perceive the change in the light subjectively, the problem that visual fatigue is easily resulted because of the long-term use of the eyes is solved effectively and it is guaranteed that the users have good vision health without interfering the user using the dynamic lighting device.

Figure 2:
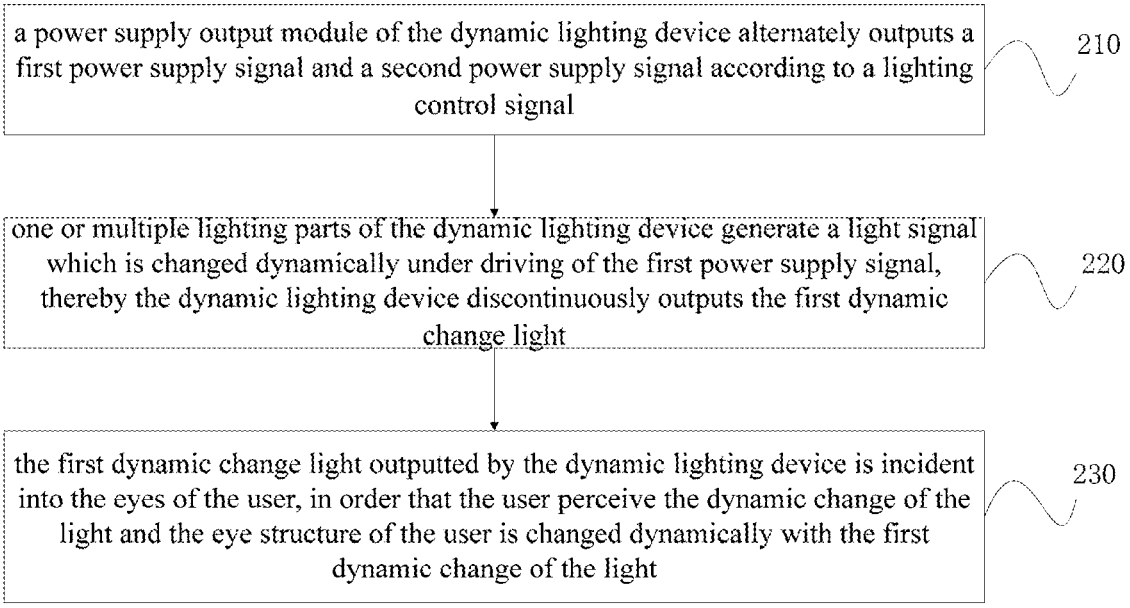
FIG. 2 is a flow chart of a dynamic lighting method provided by Embodiment 2 of the invention.

FIG. 2 is a flow chart of a light of dynamic illuminationing method provided by Embodiment 2. As shown in FIG. 2, the dynamically changing lighting method includes the following steps:

Step 210, a power supply output module of the dynamic lighting device alternately outputs a first power supply signal and a second power supply signal according to a lighting control signal.

Specifically, the power supply output module of the dynamic lighting device is a module used to provide power supply driving signal for a lighting part. The power supply driving signal includes a first power supply signal and a second power supply signal, and these two types of power supply signal are outputted in alternation. The alternation may be regular or irregular or random. The electric parameters of the first power supply signal include one or multiple groups of first electrical parameters which is changed dynamically, and the electric parameters of the second power supply signal include one or multiple groups of second electrical parameters which are predetermined and fixed or dynamically changed. In the case of multiple groups of electrical parameters, the multiple groups of electrical parameters are outputted in multi-channels. Preferably, the output time of the first power supply signal is no longer than 10 seconds every single time.

The electrical parameters mentioned above may be a current and a voltage which include the voltage value and change rate of the voltage, the current magnitude and change rate of the current, and so on. The electrical parameters may also be either a voltage or a current. The electrical parameters may be the on-off state of the output of the power supply output module.

The power supply output module may alternately output first power supply signal and second power supply signal according to an input command of a user or a predetermined setting.

In the first solution, the power supply output module may receive a lighting control command inputted by a user, and generate a lighting control signal, then alternately outputs first power supply signal and second power supply signal according to the lighting control signal.

The means for receiving the lighting control command inputted by a user may be realized via a wired or wireless way.

For example, this may be realized by sensing a lighting mode selection key provided on the dynamic lighting device which a user is touching, or This may be realized by receiving the remotely inputted lighting control command via wireless transmission by the user operating the control device.

In the second solution, the power supply output module of the dynamic lighting device alternately outputs first power supply signal and second power supply signal according to predetermined lighting control signal.

The predetermined lighting control signal may be stored in a memory storage of the dynamic lighting device, and the power supply output module reads the memory to obtain them. The memory storage may be read-only memory (ROM) chip or any other types of solid non-volatile semiconductor memories. The means for writing the predetermined lighting control signal to the memory storage may be realized in a wired input manner, may also be realized via an interface connected to the memory storage, such as an infrared interface, a Bluetooth interface, USB interface, etc.

Step 220, one or multiple lighting parts of the dynamic lighting device generate a light signal which is changed dynamically under driving of the first power supply signal, thereby the dynamic lighting device discontinuously outputs the first light of dynamic illumination.

Specifically, there may be one or multiple lighting parts connected to the power supply output module in the dynamic lighting device. When there are multiple lighting parts, these lighting parts may be controlled to be driven by the same group of electrical parameters, or controlled to be-driven by multiple groups of electrical parameters outputted in multi-channels. Therefore, these lighting parts driven by the first power supply signal may generate the first light of dynamic illumination signal at the same time or different times.

One or multiple lighting parts of the dynamic lighting device driven by the second power supply signal, generate a second light signal which are constant or dynamically changed. Therefore, the dynamic lighting device outputs the constant light or a second light of dynamic illumination, during the off-time for discontinuously outputting the first light of dynamic illumination.

Further, Each lighting part includes one or more light emitters, which are driven by the power supply signal to light or do not light or change their illumination of light emitters at different times, thus the change in the light signal outputted by every lighting part is entirely affected.

The manner for outputting a power supply signal to each lighting part of the multiple lighting parts may be implemented by outputting the same group of electrical parameters to all light emitters, by outputting a group of electrical parameters to some light emitters and outputting the other group of electrical parameters to other light emitters. In other words, the lighting parts and light emitters can be controlled independently in the method provided in this embodiment.

The following is a detailed description of the output time of the first light of dynamic illumination.

In a specific example, the illumination of lighting of these light emitters may be changed by dynamically changing the current and/or voltage which are outputted to some or all light emitters of the lighting parts, such that the first dynamic change of the first light signal outputted by the lighting parts are realized.

In a preferred embodiment, the dynamically changed current may be provided to all the light emitters of the lighting parts, such as 200 LEDs to realize outputting the dynamically changed light signal. For example, firstly, an initial current is inputted to drive the lighting parts, so that all 200 LEDs of the dynamic lighting device start to light. Subsequently, during the process of dynamically lighting, the current inputted into each light emitter increases by 5% of the initial current every 0.1 second, in order to drive these light emitters to output dynamically changed light signal. The time duration of current increasing continuously is configured for 2 seconds, therefore the first light signal outputted by the lighting part increase dynamically during this time duration. Assume that the change in illumination is proportional to the change in the current, such that the illumination of the first light signal is increased by 100% in 2 seconds dynamically. After that, the current inputted into each light emitter decreases by 5% of the initial current every 0.1 second, in order to drive these light emitters to output dynamically changed light signal. The time duration of current decreasing continuously is configured for 2 seconds, therefore the light signal outputted by the lighting part decrease dynamically during this time duration. Assume that the change in the illumination is proportional to that in the current, such that the illumination of the light signal outputted is decreased by 50% in 2 seconds dynamically.

In another example, the means for changing the illumination of light emitters to output the dynamically changed light signal can be implemented by dynamically turning on or off the output of the power from the supply output module to some light emitters of the lighting parts.

In a preferred embodiment, the lighting part has 200 individual light emitters, the power supply input of each light emitter may be controlled to be turned on or off independently. Firstly, 100 light emitters of those are controlled to be turned on by the power supply signal, and the dynamic lighting device starts to light. Then, it begins the process of dynamically lighting with turning on 10 light emitters every 0.1 second, until all the light emitters are turned on. After that, 20 light emitters are controlled to be turned off every 0.1 second, until there are 100 light emitters left. the procedures that the light emitters are turned on and off is repeated, resulting in the first dynamic change in the first light signal outputted by the lighting parts is achieved.

The exemplary change mentioned above may be implemented by that the manners that the illumination output quantity of the light signal of light emitters is increased or decreased by a fixed proportion, or by the manner that the illumination output quantity of the light signal of light emitters is dynamically changed at an unfixed proportion.

In order that the users can perceive the change of the light during the output time of the first light of dynamic illumination so that the vision system of the eyes of the users is trained, the lighting parts entirely output the light signal during the each first dynamical changed time, resulting that the change rate of the illumination of the light outputted by the dynamic lighting device is needed to be larger than 0.02 and smaller than 0.2, during any time period of 0.1 second, in case that whether the lighting parts are controlled independently or integrally, or the light emitters are controlled independently or integrally.

The principle for the above process is the visual retention of eyes that vision will maintain the feeling of a light imagine for a limited time once the light imagine is formed on retina, and this physiological phenomenon is called as persistence of vision. For different brightness in different environments, the duration of the persistence of vision is different, and the higher the brightness, the shorter the duration of the persistence of vision. Regarding the environment using the lighting device, the duration of the persistence of vision is about from 0.1 to 0.4 second in case of the environment with medium brightness. Therefore, the change rate of the illumination is set to be larger than 0.02 and smaller than 0.2 in 0.1 second, to make sure that the change in light in each duration of the persistence of vision can be perceived by the users, and not be too large to make the users feel uncomfortable or even cause visual impairment.

To achieve the effect that the discontinuous output can be perceived, during the off-time for discontinuously outputting the first light of dynamic illumination, the constant light or second dynamic change is outputted. When using the solution that the second light of dynamic illumination is outputted, the users can not perceive the change in the light during the output time of the second light of dynamic illumination. therefore, the light signal is outputted resulting that the change rate of the illumination of the light outputted by the dynamic lighting device is required to be not larger than 0.02 during any time period of 0.1 second.

Based on the same principle, the change rate of the illumination is set to be not larger than 0.02 in 0.1 second, to make sure that the change in light in each duration of the persistence of vision are sufficiently tiny and imperceptible to the users.

Therefore, the dynamic change of the outputted light can be perceived discontinuously by the users.

An example of a lighting output of 100 seconds is given in Table 1 below, it is shown that the change rate of illumination is different during different periods, and the change in the illumination are perceptible or not perceptible to the users accordingly.

TABLE 1

| lighting time (s) | change rate of illumination (every 0.01 s) | is perceptible |
|---|---|---|
| 0-25 | 0.01 | No |
| 25-27 | 0.15 | Yes |

TABLE 1-continued

| lighting time (s) | change rate of illumination (every 0.01 s) | is perceptible |
|---|---|---|
| 27-52 | 0 | No |
| 52-54 | 0.1 | Yes |
| 54-80 | 0.015 | No |
| 80-81 | 0.15 | Yes |
| 81-100 | 0.008 | No |

To meet the requirement of the application of lighting, the change of the illumination need to be within a certain range, and the lighting devices provided in this embodiment are usually used indoors, thus the illumination in this embodiment is set to range from 5 lux to 10000 lux.

Further, in order to achieve the purpose that physiological structures of the eyes of the users can be changed because of the light, the variable quantity of the illumination of the light need to at a certain proportion. At least, during the output time of the light with dynamic change which is perceptible by users, the ratio of the minimum and maximum values of the illumination of the outputted light needs to be not larger than 50%.

In specific implementation, the change of the illumination is dynamic. During every dynamic change period, the illumination may continuously increase or decrease, or it may increase with fluctuations or decrease with fluctuations.

In other words, during a dynamic change period when the illumination of the outputted light increases (including increases continuously or increases with fluctuations), the change rate for increasing the illumination is not smaller than 100%. And during a dynamic change period when the illumination of the outputted light decreases (including decreases continuously or decreases with fluctuations), the change rate for decreasing the illumination is not smaller than 50%.

The first dynamic change of the illumination in the outputted light is directly related to the change in the first power supply signal and therefore it can be configured by controlling the signal. In a preferred embodiment, the dynamic change can be set to regularly change.

In order to achieve a good visual training effect, it is stipulated that the output time of the light of dynamic illumination which is perceptible is no longer than 10 seconds every single time. And the dynamic changed light which is perceptible and the dynamic changed light which is imperceptible are outputted by turns, regarding them the output time of the dynamic changed light which is perceptible is no longer than 10% of that of the dynamic changed light which is not perceptible.

In a specific example, with a certain setting mode, the dynamic lighting device alternately outputs the constant light or the light of dynamic illumination, and that outputting the light of dynamic illumination lasts 2 seconds every time, that outputting the constant light lasts 25 seconds every time.

Further, the types of the light emitters included in a lighting part may be the same or different. For example, yellow LEDs and white LEDs can be provided in a lighting part at the same time.

Step 230, the first light of dynamic illumination outputted by the dynamic lighting device is incident into the eyes of the user, in order that the user perceive the dynamic change of the light and the eye structure of the user is changed dynamically with the first dynamic change of the light.

The perceptible light of dynamic illumination and the imperceptible light of dynamic illumination are outputted alternately through the above mentioned step 210 and step 220, the dynamic change of the light can make the eye structures, including one or more of the iris, ciliary muscle and lens, of a user is changed dynamically with the dynamic change of the light. And the problem that the user easily feels visual fatigue because of the long-term use of the eyes is solved effectively. And by the appropriate setting of the change rate of the illumination, the user can perceive the intermittent dynamic change of the light subjectively, which can be used for training the vision system.

The present invention provides a dynamic lighting method, which may automatically and dynamically change and control the electrical parameters for lighting of lighting parts, so that the dynamic lighting device alternately output the perceptible light of dynamic illumination and the imperceptible light of dynamic illumination, and the light is incident into the eyes of the user, then the physiological structures of the eyes is changed along with the change of the light accordingly, thus it may overcome the defect that the user easily feels visual fatigue because of the long-term use of the eyes, and the vision health of the user is protected. By reasonably controlling the dynamic change rate of the light, the user himself can discontinuously perceive the change of the light subjectively, which can be used for training the vision system of the eyes of the user.

Figure 3:
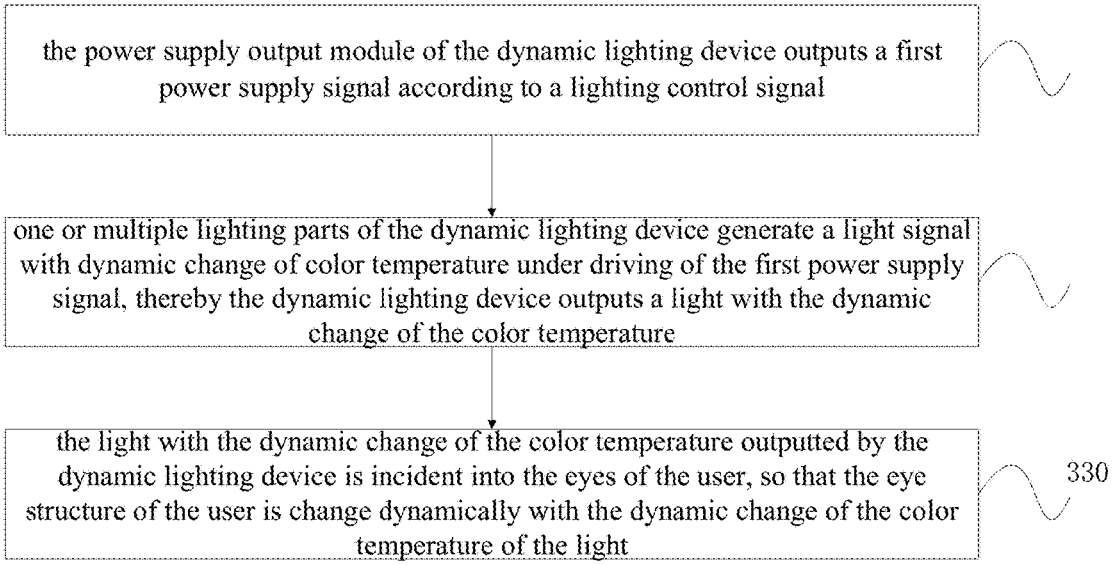
FIG. 3 is a flow chart of a dynamic lighting method with dynamic change of a color temperature provided by Embodiment 3 of the invention.

FIG. 3 is a flow chart of a dynamic lighting method provided by embodiment 3. As shown in FIG. 3, the dynamic lighting method includes:

Step 310, the power supply output module of the dynamic lighting device outputs a first power supply signal according to a lighting control signal.

Further, the power supply output module of the dynamic lighting device is a module used to provide a power supply driving signal for a lighting part. the power supply driving signal is defined as the first power supply signal, and the electric parameters of the first power supply signal include one or multiple groups of dynamically changed electrical parameters. In the case of multiple groups of electrical parameters, the multiple groups of electrical parameters are outputted in multi-channels.

The electrical parameters may be a current and a voltage, which include the voltage value and change rate of the voltage, the current magnitude and change rate of the current, and so on. The electrical parameters may be either a voltage or a current, the electrical parameters may be the on-off state of the output of the power supply output module.

The power supply output module may output the first power supply signal according to an input command of a user or a predetermined setting.

In the first solution, the power supply output module may receive a lighting control command inputted by a user, and generate a lighting control signal, then outputs the first power supply signal according to the lighting control signal.

The means for receiving the lighting control command inputted by the user may be implemented via a wired or wireless way.

For example, this may be implemented by sensing a lighting mode selection key provided on the dynamic lighting device which a user is touching, or This may be implemented by receiving the remotely inputted lighting control command via wireless transmission by the user operating the control device.

In the second solution, the power supply output module of the dynamic lighting device outputs the first power supply signal according to the predetermined lighting control signal.

The predetermined lighting control signal may be stored in a memory storage of the dynamic lighting device, and the power supply output module reads the memory storage to obtain them. The memory storage may be read-only memory (ROM) chip or any other types of solid non-volatile semiconductor memories. The manner for writing the predetermined lighting control signal to the memory may be realized in a wired input manner, may be realized via an interface connected to the memory storage, such as an infrared interface, a Bluetooth interface, a USB interface, etc.

Step 320, one or multiple lighting parts of the dynamic lighting device generate a light signal with dynamic change of color temperature under driving of the first power supply signal, thereby the dynamic lighting device outputs a light with the dynamic change of the color temperature.

Specifically, there may be one or multiple lighting parts connected to the power supply output module in the dynamic lighting device. When there are multiple lighting parts, these lighting parts may be controlled to be driven by the same group of electrical parameters, or controlled to be driven by multiple groups of electrical parameters outputted in multi-channels. Therefore, these lighting parts driven by the first power supply signal may generate a light signal with the dynamic change of the color temperature at the same time or different times.

Further, the types of the light emitters included in lighting parts may be the same or different, each lighting part includes one or more light emitters Which are driven by the first power supply signal, to light or do not light or change their color temperature for lighting, thus the change of the light signal outputted by every lighting part is entirely affected.

The manner for outputting the power supply signal to each lighting part of the multiple lighting parts may be implemented by outputting the same group of electrical parameters to all light emitters, by outputting a group of electrical parameters to some light emitters and outputting the other group of electrical parameters to other light emitters. In other words, the lighting parts and light emitters can be controlled independently in the method provided in this embodiment.

In a specific example, the color temperature for lighting of these light emitters may be changed by dynamically changing the current and/or voltage which are outputted to some or all light emitters of the lighting parts, such that the color temperature of the light signal outputted by the lighting parts is changed dynamically.

Taking power white LEDs as an example of the light emitters, the color temperature can be changed by changing the current.

As the driving current of the device increases, the color temperature of the power white LEDs will increase gradually. This is because, after the current increases, the blue light emitted from chips increases, and the thickness of phosphor layer is constant, such that the blue light component of white light will increase, and the color temperature of the device will increase.

In another specific example, that can be implemented by dynamically turning on or off the output of the power from the supply output module to different types of light emitters of the lighting parts. In a preferred embodiment, the lighting part has 100 individual light emitters, they may have some yellow light LEDs and some white light LEDs, the power supply input of every light emitter can be turned on and off independently. Firstly, some light emitters of those are turned on controlled by a power supply signal, for example, all yellow light LEDs are controlled to be turned on firstly, then one white light LED is turned on every 0.1 second, until all the light emitters are turned on. After that, one white light LED is controlled to be turned off every 0.1 second, until all the white light LEDs are turned off. The procedures that the white light LEDs are turned on and off one by one is repeated and meanwhile the yellow light LEDs keep lighting, thus the color temperature of the light signal outputted by the lighting parts is dynamically changed.

In order not to affect the users' normal use of lighting devices, the lighting parts generate a light signal that is changed dynamically driven by the first power supply signal, resulting that the change of the color temperature of the light outputted by the dynamic lighting device, is not larger than 10K during any time period of 0.1 second, in case that whether the lighting parts are controlled independently or integrally, or the light emitters are controlled independently or integrally.

The basis for the above process is the visual retention of eyes that vision will maintain the feeling of a light imagine for a limited time once the light imagine is formed on retina, and this physiological phenomenon is called as persistence of vision. For different brightness in different environments, the duration of the persistence of vision is different, and the higher the brightness, the shorter the duration of the persistence of vision. Regarding the environment using the lighting device, the duration of the persistence of vision is about from 0.1 to 0.4 second in case of the environment with medium brightness. Therefore, the change of the color temperature is set to be not larger than 10K during 0.1 second, to make sure that the change of light in each duration of the persistence of vision are tiny, so that the change of the color temperature of the light are imperceptible to the users of the lighting device and will not interfere the users' normal use of the lighting device.

The change of the color temperature needs to be within a certain range to meet the requirement for lighting. The color temperature in this embodiment is set to range from 2500K to 6500K, to meet the requirement for indoors lighting.

The dynamic change of the color temperature of the outputted light are directly related to the change of the first power supply signal so it can be set as being regularly or irregularly changed by controlling the signal. In a preferred embodiment, the dynamic change can be set as regular change.

Step 330, the light with the dynamic change of the color temperature outputted by the dynamic lighting device is incident into the eyes of the user, so that the eye structure of the user is change dynamically with the dynamic change of the color temperature of the light.

The light with the dynamic change of the color temperature generated by step 310 and step 320 mentioned above, is incident into the eyes of the user of the dynamic lighting device, so that the eyes structure, including one or more of the iris, ciliary muscle and lens, of the user is changed dynamically with the dynamic change of the color temperature of the light. And with the reasonable setting of the change of the color temperature during the duration of the persistence of vision, the user will not perceive the dynamic change of the light subjectively, thus it will not influence the user using the dynamic lighting device normally.

In addition, since different color temperature can make people's perception of surrounding environment different, the change of the color temperature of the light may have a beneficial effect on working and easing brain fatigue for the users in the environment.

For example, the dynamic lighting method with changeable color temperature, provided by this embodiment can be applied in teaching environment. Before the beginning of teaching or at beginning, the light of which color temperature is warmer is controlled for lighting, so people will feel more relaxed in such environment. As time goes on, the dynamic lighting device is controlled to automatically and dynamically adjust the color temperature for lighting and the color temperature increases gradually, so that the light in the environment gradually change from warm light to cold light. In the case of higher color temperature, the attention of people is more concentrated, thus it is beneficial for learning in education.

However, resolution in the environment with high color temperature is high, so it is more likely to feel visual fatigue if people stay in the environment with high color temperature for a long time. As a course progresses, the output of the dynamic lighting is controlled to adjust to warm light at the end of the course, so that it allows people to relax both in the vision system and in their attention.

It is beneficial for improving work efficiency and easing brain fatigue by reasonably changing the color temperature of the light of the dynamic lighting.

The present invention provides a dynamic lighting method with dynamic change of the color temperature, which may automatically and dynamically change and control the electrical parameters for lighting of lighting parts, so that the dynamic lighting device output the light of which color temperature is changed dynamically, and the light is incident into the eyes of the user, then the physiological structures of the eyes is changed alone with the change of the light accordingly, thus it may overcome the defect that user easily feels visual fatigue because of the long-term use of the eyes, and the vision health of the user is protected, without influencing the user using the dynamic lighting device normally at the same time. In addition, the change of the color temperature of the light have a beneficial effect on working and easing brain fatigue for the users in the environment, by reasonably controlling the trend of the dynamic change of the color temperature of the light.

Figure 4:
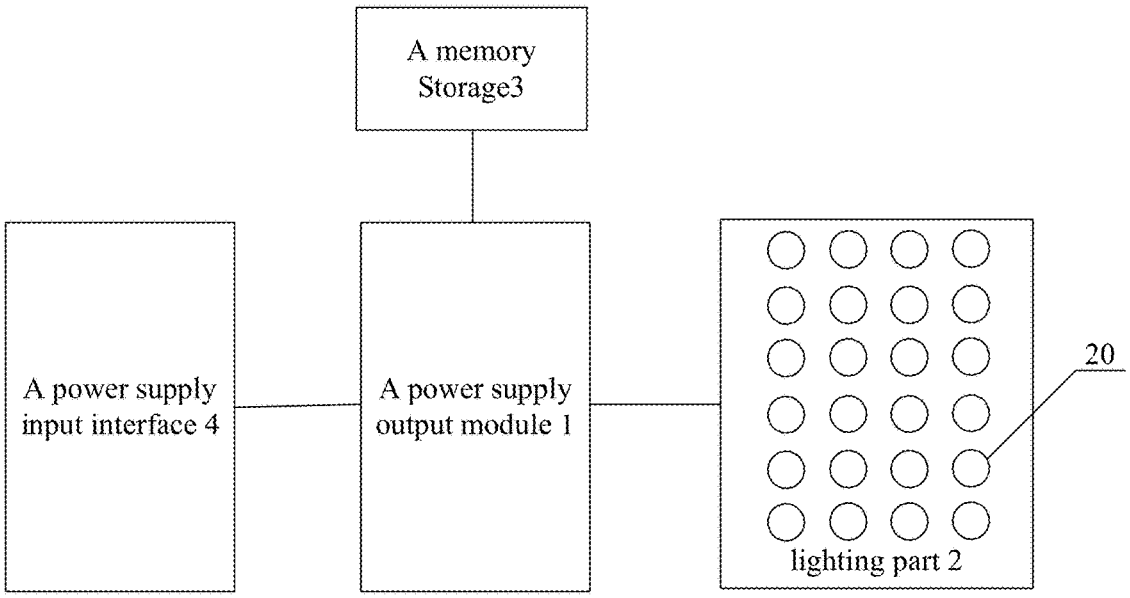
FIG. 4 is a schematic diagram of a dynamic lighting device provided by Embodiment 4 of the invention.

Accordingly, a dynamic lighting device is provided by embodiment 4 for implementing the methods mentioned above. As shown in FIG. 4, the dynamic lighting device includes a power supply output module 1, a lighting part 2, a memory storage 3 and a power supply input interface 4.

The output of the power supply input interface 4 is connected with the input of the power supply output module 1, and an external power supply is connected to the dynamic lighting device through the power supply input interface 4, and the external power can be supplied by commercial power or battery specifically.

The memory storage 3 is connected to the power supply output module 1. The memory storage 3 stores the lighting control signal. The lighting control signal may be stored in the memory storage 3 in advance, or may be generated based on a lighting control command which is inputted by a user and received by the input device (not shown in the figure) of the dynamic lighting device, the lighting control signal are sent to the power supply output module 1, and stored in the memory storage 3.

The memory storage 3 may be read-only memory (ROM) chip or any other types of solid non-volatile semiconductor memories. The manner for writing the predetermined lighting control signal to the memory may be realized in a wired input manner, may also be realized via an interface connected to the memory, such as an infrared interface, a Bluetooth interface, a USB interface, etc. . . .

The power supply output module 1 reads the lighting control signal from the memory storage 3, and outputs the first power supply signal according to the lighting control signal. The electric parameters of the first power supply signal include one or multiple groups of electrical parameters which are changed dynamically. In the case of multiple group of electrical parameters, the multiple groups of electrical parameters are outputted in multi-channels.

The electrical parameters may be a current and a voltage, which include the voltage value and change rate of the voltage, the current magnitude and change rate of the current, and so on. The electrical parameters may be either a voltage or a current, and be the on-off state of the output of the power supply output module.

The dynamic lighting device includes one or multiple lighting parts 2 generate the light signal which is dynamically changed under driving of the first power supply signal change, therefore the dynamic lighting device outputs the light of dynamic illumination. The light of dynamic illumination is incident into the eyes of a user, resulting that the eyes structure of the user is changed dynamically with the dynamic change in the light.

When the multiple groups of electrical parameters are outputted in multi-channels by the power supply output module 1, the multiple lighting parts can be connected to one of the multi-channels respectively. The light signal which is dynamically changed outputted by the multiple lighting parts 2 may be generated at the same time or different time.

Therefore, the output of the light of dynamic illumination may be continuous or discontinuous. The dynamic change of the light includes dynamic change of the illumination, and that of the color temperature, and so on.

The mode for outputting the dynamic change of the light by the dynamic lighting device include two types of being perceptible or imperceptible to the users. The mode being perceptible to the users can be correspondingly used in visual training scenarios, and the mode being imperceptible to the users can be used in application scenarios of daily lighting.

In a specific implementation of discontinuously outputting the dynamically changed light, the power supply output module 1 outputs a second power supply signal in addition to the first power supply signal, the first power supply signal and second power supply signal are alternately outputted at different time. The electric parameters of the second power supply signal include one or multiple groups of electrical parameters which are predetermined and fixed or dynamically changed. One or multiple lighting parts 2 generate a second light signal which is constant or dynamically changed under driving of the second power supply signal. Thus, the dynamic lighting device outputs the constant light or second light of dynamic illumination, during the off-time for discontinuously outputting the first light of dynamic illumination. The users can perceive the dynamic change in the first light of dynamic illumination, but they cannot perceive dynamic change of the constant light or second light of dynamic illumination. Therefore, it can realize that the light with perceptible dynamic change and that without perceptible dynamic change is alternately outputted in this solution.

It will be detailed describe the working manner for the users can perceive dynamic change and can not perceive dynamic change.

When the mode that the users can not perceive dynamic change is selected, the dynamic lighting device can be used in the application of scenarios of daily lighting.

The lighting part 2 is driven by the first power supply signal, and generates a light signal which is changed dynamically, so that the light outputted by the dynamic lighting device is changed dynamically accordingly. If the illumination is changed, the change rate of the illumination is not larger than 0.02 during any time period of 0.1 second. If the color temperature is changed, the change of the color temperature is not larger than 10K during any time period of 0.1 second.

The principle for the above process is the visual retention of eyes that vision will maintain the feeling of a light imagine for a limited time once the light imagine is formed on retina, and this physiological phenomenon is called as persistence of vision. For different brightness in different environments, the duration of the persistence of vision is different, and the higher the brightness, the shorter the duration of the persistence of vision. Regarding the environment using a lighting device, the duration of the persistence of vision is about from 0.1 to 0.4 second in case of the environment with medium brightness. Therefore, the change rate of the illumination are set to be not larger than 0.02 or the change of the color temperature are set to be not larger than 10K during any time period of 0.1 second, to make sure that the change of the light in each duration of the persistence of vision are tiny, so that the change of the light are imperceptible to the users of the lighting device and will not interfere with the users' normal use of the lighting device.

The change of the illumination or the color temperature need to be controlled within certain ranges, to meet the requirement for lighting. If the illumination is changed, the illumination ranges from 50 lux to 10000 lux. If the color temperature is changed, the color temperature ranges from 2500K to 6500K.

In addition, in the case that the illumination is changed, in order to achieve the purpose that physiological structures of the eyes of the users is changed because of the light, the variable quantity of the illumination of the light need to achieve a certain proportion, and the ratio of the minimum and maximum values of the illumination of the outputted light needs to be not larger than 50%. The change of the illumination what say here are dynamic, in different dynamic change periods, the illumination may increase continuously or decrease continuously, may increase with fluctuations or decrease with fluctuations. And the light is incident into the eyes of the users, so that the physiological structure of the eyes is changed with the change of the illumination of the light accordingly, thereby it overcomes the detects that the users easily feel visual fatigue because of the long-term use of the eyes.

In the case that the color temperature is changed, the problem that the users easily feel visual fatigue because of the long-term use of the eyes can be solved effectively through the change of the color temperature of the light. In addition, by controlling the change of the color temperature of the light, there is a beneficial effect on improving work efficiency and easing brain fatigue for the users.

Under the mode that the users can perceive dynamic change, the dynamic lighting device provided by this embodiment may be applied in visual training scenarios.

Preferably, the dynamic lighting device is implemented to discontinuously output the light with perceptible dynamic change.

The lighting part 2 is driven by the first power supply signal, and generates the dynamically changed light signal, so that the change rate of the illumination of the light outputted by the dynamic lighting device are larger than 0.02 and smaller than 0.2 during any time period of 0.1 second.

As well the change rate of the illumination is set to be larger than 0.02 and smaller than 0.2 during any time period of 0.1 second based on the principle of persistence of vision mentioned above, so that it guarantee that the change of the light in each duration of the persistence of vision may be perceived by the users, and not be too large to make the users feel uncomfortable or even cause visual impairment.

To achieve a better visual training effect, the output time of a first power supply signal is no longer than 10 seconds every single time, that is, the output time of the light with perceptible dynamic change is no longer than 10 seconds every single time. Between the two output time duration of the light with perceptible dynamic change, the light without perceptible dynamic change is outputted, which may be the constant light or the light of dynamic illumination, may be any other light which meets the conditions that the users can not perceive the change of the illumination, color temperature, or other parameters.

In a preferred embodiment, the light with perceptible dynamic change is outputted alternately with the dynamically changed light without perceptible. The output time of the light with perceptible dynamic change is no longer than 10% of that of the dynamically changed light without perceptible between two adjacent output time.

Therefore, the users can perceive the dynamic change subjectively, which can be applied for training the vision system by appropriately setting the change rate of the illumination of the light outputted by the dynamic lighting device.

The dynamic change of the outputted light is directly related to the change of the first power supply signal, therefore, the dynamic change can be set by controlling the signal. In a preferred implementation, the dynamic change can be set to regular change.

In this embodiment, the lighting part 2 may include one or more light emitters 20, the types of which may be the same or different. Different types of light emitters can be the light emitters with different color temperature, such as yellow light LEDs and white light LEDs. Additionally, the light emitters 20 may be other types of light sources other than LED, such as tungsten lamp beads, OLED, etc.

It will be detailed describe several embodiments of the dynamic lighting device in three examples provided by this invention.

Figure 5:
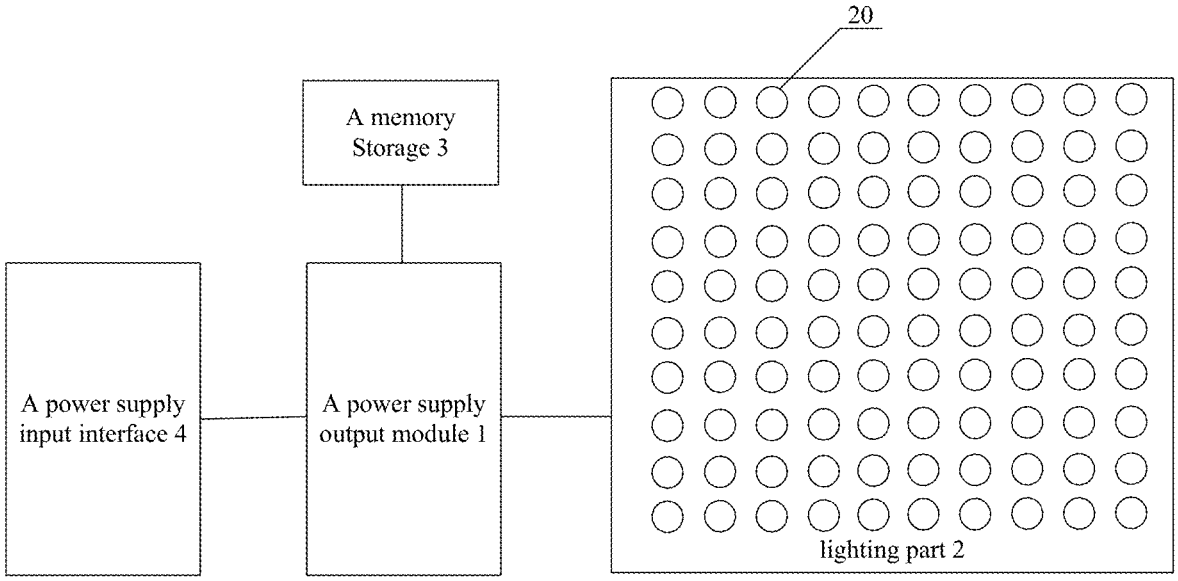
FIG. 5 is one schematic diagram of a dynamic lighting device provided by embodiment of the invention.

In the first example, as shown in FIG. 5, the dynamic lighting device includes one lighting part 2, which is connected with the output of the power supply output module 1 and may receive a power supply signal. The output of the power supply input interface 4 is connected with the input of the power supply output module 1, and the external power supply is connected to the dynamic lighting device through the power supply input interface 4. The memory storage 3 is connected with the power supply output module 1. The memory storage 3 stores the lighting control signal.

The lighting part 2 has 100 individual light emitters 20, which may be the same type of light emitters in this example, such as white light LEDs. The power supply input of every light emitter 20 is connected to the power supply output module 1 independently, and is controlled to be turned on and off by the power supply signal.

In an example, 50 light emitters 20 are firstly controlled to be turned on by power supply signal, and the dynamic lighting device starts to light. Then, one light emitter 20 is turned on every 0.1 second, until all the light emitters 20 are turned on. After that, one light emitter 20 is controlled to be turned off every 0.1 second, until there are 50 light emitters 20 left lighting. As a result, it realizes that the illumination of the light outputted by the dynamic lighting device is dynamically changed.

The change mentioned above may be the output quantity of the light signal of light emitters increased or decreased by a fixed proportion, to keep the change rate of the illumination in every duration consistent, or be the output quantity of the light signal of light emitters increased or decreased by a unfixed proportion.

In this example, the change rate of the illumination of the light outputted by the dynamic lighting device are not larger than 0.02 during any time period of 0.1 second, therefor, the dynamic change of the light will not be perceived by the users and can meet the need for daily lighting. The dynamic lighting device provided by this example may output the dynamically changed light, which is incident into the eyes of the users, so that the physiological structure of the eyes is changed with the change of the light accordingly, thus the problem that the users easily feel visual fatigue because of the long-term use of the eyes is solved effectively.

Figure 6:
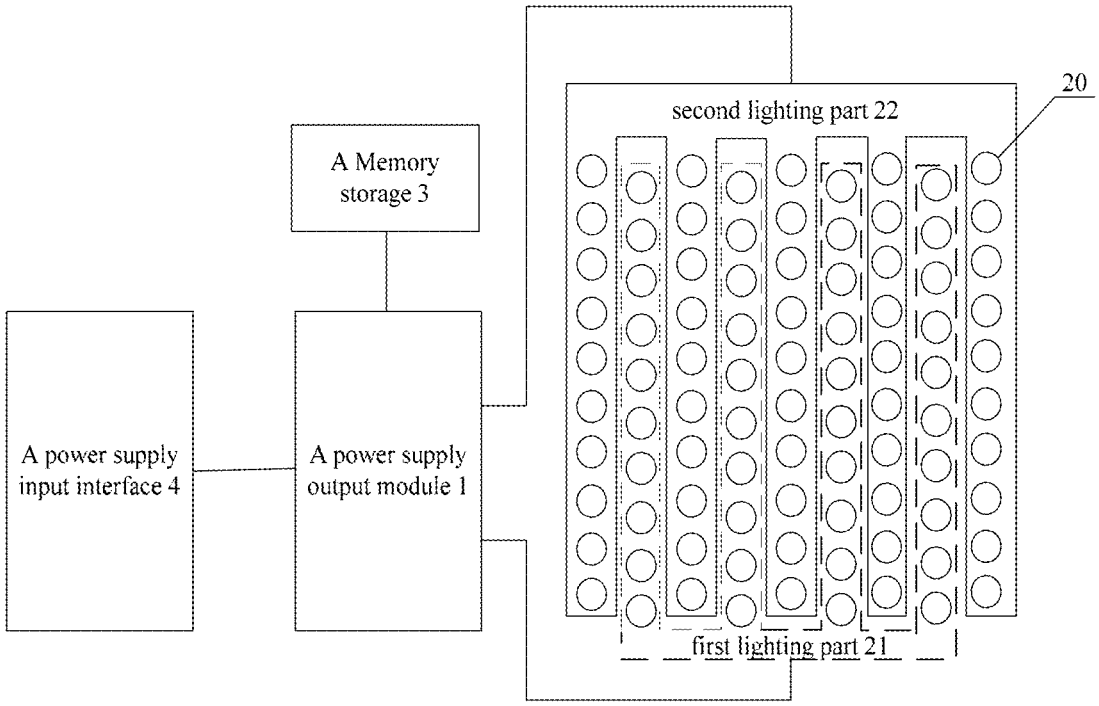
FIG. 6 is another schematic diagram of a dynamic lighting device provided by embodiment of the invention.

In the second example, as shown in FIG. 6, the dynamic lighting device includes two lighting parts, respectively a first lighting part 21 and a second lighting part 22. The first lighting part 21 and the second lighting part 22 are connected with the output of the power supply output module 1 separately. The output of the power supply input interface 4 is connected with the input of the power supply output module 1, and an external power supply is connected to the dynamic lighting device through the power supply input interface 4. The memory storage 3 is connected with the power supply output module 1. And The memory storage 3 stores the lighting control signal.

The first lighting part 21 includes 40 light emitters 20, and the second lighting part 22 includes 50 light emitters 20. The power supply input of all the light emitters 20 in the first lighting part 21 are integrally controlled to be turned on or off. The 50 light emitters 20 in the second lighting part 22 are divided into 10 groups, each group has 5 light emitters which are turned on or off simultaneously. In this example, these light emitters can be the same type of light emitters, such as white light LEDs.

All the light emitters 20 in the first lighting part 21 are controlled to be turned on by the power supply signal firstly, and the dynamic lighting device starts to light, keeping for 25 seconds. Then one group of the light emitters 20 in the second lighting part 22 is turned on every 0.1 second, until all the light emitters are turned on, and it takes 1 second, during this procedure the outputted light is changed dynamically. The 90 light emitters are kept lighting for 25 seconds. After that, one group of the light emitters 20 in the second lighting part 22 is controlled to be turned off every 0.1 second, until all the light emitters 20 in the second lighting part 22 are turned off, and it takes 1 second, during this process the light outputted is changed dynamically. At this point, all the light emitters 20 in the first lighting part 21 are kept lighting, all the light emitters 20 in the second lighting part 22 are kept being off After keeping that for 25 seconds, the procedures that the light emitters 20 in the second lighting part 22 are turned on, kept, and turned off, group by group are repeated, thus it is realized that the illumination of the light outputted by the dynamic lighting device is dynamically changed In this example, in each repeated period of the dynamic output of the light outputted by the dynamic lighting device, a constant output period is two discontinuous periods of 25 seconds, while a dynamic output period is two discontinuous periods of 1 second. The change rate of the illumination is larger than 0.02 and smaller than 0.2 during any time period of 0.1 second of the dynamic output. Therefore, the dynamic change of the light can be perceived by the users and can be applied for training the vision system of the users.

During the constant output period mentioned in this example, the output of the light may be the output of non-constant light in other examples, but the change rate of the illumination of the light outputted in this period needs to be not larger than 0.02 in 0.1 second, that is, the dynamic change of the light may not be perceived by the users, the discontinuous output of the light with perceptible dynamic change is realized, which can be used for training the vision system of the users.

The dynamic lighting device provided by this example can alternately output the light with perceptible dynamic change and the light without perceptible dynamic change, and the light of dynamic illumination is incident into the eyes of a user, so that the physiological structure of the eyes is changed with the change of the light accordingly, so that the problem that the users easily feel visual fatigue because of the long-term use of the eyes is solved effectively, and it is helpful for improving the function of the vision system.

Figure 7:
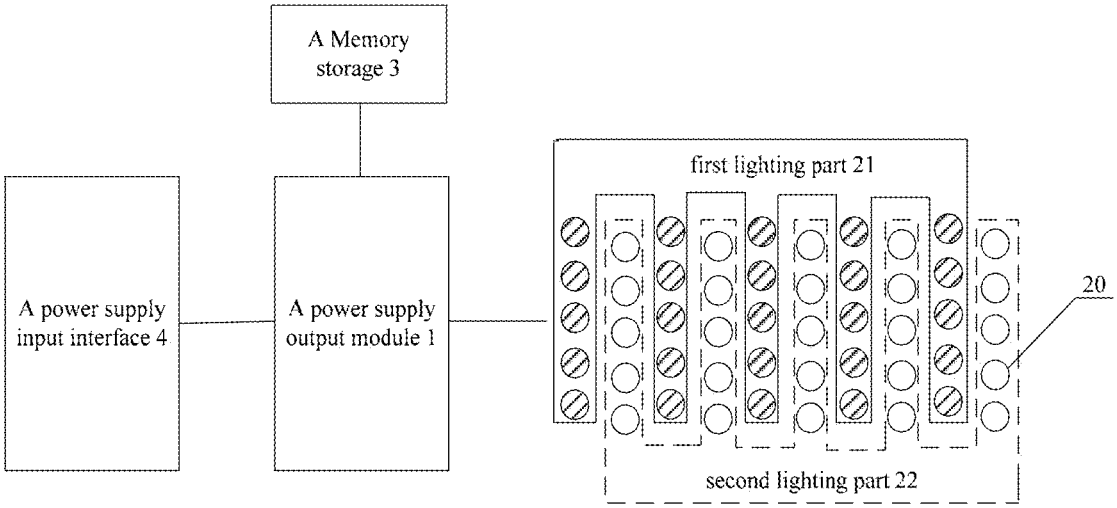
FIG. 7 is further schematic diagram of a dynamic lighting device provided by embodiment of the invention.

As shown in FIG. 7, in the third example the dynamic lighting device includes two lighting parts 2, namely, a first lighting part 21 and a second lighting part 22. The first lighting part 21 and second lighting part 22 are connected with the output of the power supply output module 1 separately. The output of the power supply input interface 4 is connected with the input of the power supply output module 1, and external power supply is connected to the dynamic lighting device through the power supply input interface 4. The memory storage 3 is connected with the power supply output module 1. The memory storage 3 stores the lighting control signal.

Both the first lighting part 21 and the second lighting part 22 include 25 light emitters 20, wherein the first lighting part 21 adopts yellow light LEDs and the second lighting part 22 adopts white light LEDs. The power supply input of all the light emitters 20 in the first lighting part 21 are integrally controlled to be turned on or off while 25 light emitters 20 in the second lighting part 22 is independently controlled to be turned on or off one by one.

All the yellow light LEDs in the first lighting part 21 are controlled to be turned on firstly by the power supply signal, then one white light LED in the second lighting part 22 is turned on every 0.1 second, until all the light emitters start to light. After that, one white light LED is controlled to be turned off every 0.1 second, until all the white light LEDs are turned off. The procedures that white light LEDs are turned on and off one by one is repeat, while the yellow light LEDs are kept lighting, thus it is realized that the color temperature of the light signal outputted by the lighting parts is dynamically changed.

In this embodiment, the change of the color temperature of the light outputted by the dynamic lighting device is not larger than 10K during any time period of 0.1 second. Therefore, the dynamic change of the light will not be perceived by the users and will meet the need for daily lighting. Therefore, the problem that the users easily feel visual fatigue because of the long-term use of the eyes is solved effectively by outputting the light with the dynamic change of the color temperature.

The dynamic lighting device provided by this embodiment can be applied in different environments, such as working or teaching environment, to provide the change of the color temperature that the users need.

Take this embodiment as an example for the dynamic lighting device applied in teaching environment. Before the beginning of teaching or at beginning, the light of which the color temperature is warmer is controlled for lighting, the user will feel more relaxed in such environment. As time goes on, the dynamic lighting device is controlled to automatically and dynamically adjust the color temperature of lighting and the color temperature increases gradually, resulting that the light in the environment is gradually changed from warm light to cold light. In the case of higher color temperature, the attention of people is more concentrated, thus it is beneficial for learning efficiently in teaching environment. However, the resolution in the environment with high color temperature is high, so it is more likely to feel visual fatigue if people stay in the environment with high temperature for a long time. As a course progresses, the output of the dynamic lighting is controlled to be adjusted to warm light at the end of the course, thus it allows people to relax both in the vision system and in their attention. It is beneficial for improving work efficiency and easing brain fatigue by appropriately changing the color temperature of the light of the dynamic lighting.

A person skilled in the art should be further understood that the units and algorithm steps of each example described in connection with the embodiments disclosed herein can be implemented in electronic hardware, computer software or a combination of both, in order to clearly illustrate the alternative of hardware and software, the composition and steps of the examples have been generally described in terms of functions in the above description. Whether these functions are performed in hardware or software depends on the specific application and design constraints of technical solutions. A person skilled in the art can use different methods for implementing the described functions for each particular application, but such implementation should not be considered to be beyond the scope of the present invention.

The steps of the method or algorithm described in connection with the embodiments disclosed herein can be implemented in hardware, a software module executed by a processor, or a combination of both. The software module can be placed in random access memory (RAM), memory, read only memory (ROM), electrically programmable ROM, electrically erasable programmable ROM, registers, hard disk, removable disk, CD-ROM, or any other form of storage medium known in the art.

Above mentioned specific embodiments further describe aims, technical solutions and beneficial effects of the invention in detail, it should be understood that the above mentioned is merely specific embodiment of the present invention without limiting a protection scope of the present invention, and any modifications, equivalent substitutions, improvement, etc. made within the spirit and principle of the present invention should be included in the scope of the present invention.

What is claimed is:

1. A dynamic lighting method, comprising:

outputting by a power supply output module of a dynamic lighting device a first power supply signal according to a lighting control signal, wherein electric parameters of the first power supply signal comprise one or more groups of dynamically changed electrical parameters, generating a dynamically changing light signal by one or more lighting parts of the dynamic lighting device driven by the first power supply signal, and outputting a light of dynamic illumination;

wherein a change rate of illumination of the light of dynamic illumination is not more than 0.02 during any time period of 0.1 second, and a ratio of the minimum to maximum value of the illumination is not more than 50%.

2. The dynamic lighting method of claim 1, comprising outputting the light of dynamic illumination incident into eyes of a user, so that eye structure of the user is changed dynamically with dynamic change of the light.

3. The dynamic lighting method of claim 1, wherein illumination of the light of dynamic illumination ranges from 50 lux to 10000 lux.

4. The dynamic lighting method of claim 1, wherein the one or more lighting parts are configured to generate the dynamically changed light signal driven of the first power supply signal;

wherein the one or more lighting parts comprise multiple light emitters, and the electrical parameters comprise current and voltage, and all or some light emitters of the one or more lighting parts driven by the first power supply signal are configured to change illumination for lighting of the light emitters;

wherein the electrical parameters comprise an on-off state of the power supply, and some light emitters of the one or more of the lighting parts driven by the first power supply signal are configured to be turned on or off.

5. The dynamic lighting method of claim 1, comprising receiving by the power supply output module a lighting control command inputted by the user, generating the lighting control signal, and outputting the first power supply signal according to the lighting control signal; or outputting by the power supply output module the first power supply signal according to a lighting control signal that is predetermined.

6. A dynamic lighting method, comprising:

alternately outputting by a power supply output module a first power supply signal and a second power supply signal according to a lighting control signal, wherein electric parameters of the first power supply signal comprise one or more groups of first electrical parameters which are changed dynamically, and electric parameters of the second power supply signal comprise one or more groups of second electrical parameters which are predetermined and fixed or dynamically changed, generating by one or more lighting parts of the dynamic lighting device a first light signal which is changed dynamically driven by the first power supply signal, so that a dynamic lighting device is configured to discontinuously output a first light of dynamic illumination;

wherein a change rate of illumination of the first light of dynamic illumination is between 0.02 to 0.2 during any time period of 0.1 second, and a ratio of the minimum to maximum value of the illumination is not more than 50% during a single output time duration of the first light of dynamic illumination outputted by the dynamic lighting device.

7. The dynamic lighting method of claim 6, comprising outputting the first light of dynamic illumination incident into eyes of a user, so that the user perceives dynamic change of the light and eye structure of the user is changed dynamically with first dynamic change of the light;

through one or more lighting parts of the dynamic lighting device driven by the second power supply signal, generating a second light signal which is constant or dynamically changed, so that the dynamic lighting device outputs a constant light or a second light of dynamic illumination, during an off-time for outputting the first light of dynamic illumination;

wherein a change rate of the illumination of the second light of dynamic illumination is not more than 0.02 during any time period of 0.1 second;

wherein an output time duration of the first light of dynamic illumination is no longer than 10% of an off-time that is an interval between a present output time and a next output time, and no longer than 10% of an off-time that is an interval between a previous output time and the present output time;

and wherein the output time duration of the first light of dynamic illumination is no more than 10 seconds every single time.

8. The dynamic lighting method of claim 6, wherein the illumination of the light ranges from 5 lux to 10000 lux.

9. The dynamic lighting method of claim 6, wherein the one or more lighting parts are configured to generate the first light signal which is changed dynamically driven by the first power supply signal;

wherein the lighting parts comprise multiple light emitters;

wherein the electrical parameters comprise current and voltage, and all or some light emitters of the one or more lighting parts driven by the first power supply signal are configured to change their illumination for lighting of the light emitters; or the electrical parameters comprise an on-off state of a power supply, and some light emitters of the one or more lighting parts driven by the first power supply signal are configured to be turned on or off.

10. The dynamic lighting method of claim 6, comprising:

through the power supply output module of the dynamic lighting device, receiving a lighting control command inputted by a user, generating the lighting control signal, and alternately outputting the first power supply signal and the second power supply signal according to the lighting control signal, or through the power supply output module of the dynamic lighting device, alternately outputting the first power supply signal and the second power supply signal according to a lighting control signal that is predetermined.

11. A dynamic lighting method, comprising:

through a power supply output module of a dynamic lighting device, outputting a first power supply signal according to a lighting control signal, wherein electric parameters of the first power supply signal comprise one or more groups of dynamically changed electrical parameters;

through one or more lighting parts of the dynamic lighting device, generating a light signal with dynamic change of color temperature driven by the first power supply signal, so that the dynamic lighting device is configured to output a light with dynamic change of color temperature.

12. The dynamic lighting method of claim 11, comprising outputting the light with the dynamic change of the color temperature by light of dynamic illumination incident into eyes of a user, so that eyes structure of the user is dynamically changed with the dynamic change of the color temperature of the light.

13. The dynamic lighting method of claim 11, wherein change of the color temperature of the light is no more than 10K during any time period of 0.1 second; and the change of the color temperature of the light ranges from 2500K to 6500K.

14. The dynamic lighting method of claim 11, wherein the one or more lighting parts driven by the first power supply signal are configured to generate the light signal with the dynamic change of the color temperature at same time, or the one or more lighting parts driven by the first power supply signal are configured to generate the light signal with the dynamic change of the color temperature at different time;

wherein the lighting parts comprise one or more light emitters;

wherein the electrical parameters comprise current and voltage, and all or some light emitters of one or more lighting parts driven by the first power supply signal change the color temperature of the light emitters;

wherein the electrical parameters comprise an on-off state of a power supply, different light emitters of the one or more lighting parts driven by the first power supply signal are configured to be turned on or off.

15. The dynamic lighting method of claim 11, comprising:

through the power supply output module of the dynamic lighting device, receiving a lighting control command inputted by a user, generating the lighting control signal, and outputting the first power supply signal according to the lighting control signal, or through the power supply output module of the dynamic lighting device, outputting the first power supply signal according to the lighting control signal which is predetermined.

16. A dynamic lighting device, comprising: through a power supply output module, outputting a first power supply signal according to a lighting control signal, wherein electric parameters of the first power supply signal comprise one or multiple groups of electrical parameters which are changed dynamically;

generating a light signal which is changed dynamically under driven by the first power supply signal so that the dynamic lighting device is configured to output a light of dynamic illumination incident into eyes of a user, so that eye structure of the user is changed dynamically with the dynamic change of the light.

17. The dynamic lighting device of claim 16, wherein the lighting parts used for generating a light with a change rate of the illumination no more than 0.02 during any time period of 0.1 second, driven by the first power supply signal.

18. The dynamic lighting device of claim 16, wherein the lighting parts are configured to generate a light of which dynamic change of color temperature is not larger than 10K during any time period of 0.1 second, driven by the first power supply signal.

19. The dynamic lighting device of claim 16, wherein the lighting parts are configured to generate a light of which change rate of illumination is between 0.02 to 0.2 during any time period of 0.1 second, driven by the first power supply signal;

wherein the power supply output module is configured to output a second power supply signal, the second power supply signal and the first power supply signal are configured to be alternately outputted according to the lighting control signal;

wherein the one or more lighting parts are configured to generate a second light signal which is constant or dynamically changed, so that the dynamic lighting device is configured to output a constant light or a second light of dynamic illumination, during an off-time for outputting a first light of dynamic illumination;

wherein a change rate of the illumination of the second light of dynamic illumination is not larger than 0.02 during any time period of 0.1 second.

20. The dynamic lighting device of claim 16, wherein the one or more lighting parts are configured to generate the light signal which is changed dynamically driven by the first power supply signal;

wherein the one or more lighting parts comprise multiple light emitters of one or more types, the electrical parameters comprise current and voltage;

wherein all or some of the multiple light emitters driven by the first power supply signal change their illumination or color temperature;

wherein the electrical parameters comprise an on-off state of the power supply;

wherein some of the multiple light emitters driven by the first power supply signal are configured to be turned on or off;

wherein the dynamic lighting device further comprises a power supply input interface;

wherein an output of the power supply input interface is connected with an input of the power supply output module, for connecting external power supply to the dynamic lighting device;

wherein the dynamic lighting device further comprises a memory storage connected with the power supply output module;

wherein the memory storage is for storing the lighting control signal;

wherein the power supply output module is for obtaining the lighting control signal stored in the memory storage;

wherein the dynamic lighting device further comprises an input device; connected with the power supply output module;

wherein the input device is configured for receiving lighting control command which are inputted by a user, generating the lighting control signal according to the lighting control command, and sending the lighting control signal to the power supply output module.

* * * * *